US006040060A

United States Patent [19]

Missel et al.

[11] Patent Number: 6,040,060

[45] Date of Patent: Mar. 21, 2000

[54] HIGH UNIFORM GLOSS INK-JET RECEIVERS

[75] Inventors: Gregory E. Missel, Penfield; Charles E. Romano, Rochester, both of N.Y.

[73] Assignee: Eastman Kodak Company, Rochester, N.Y.

[21] Appl. No.: 08/948,831

[22] Filed: Oct. 10, 1997

[51] Int. Cl.[7] ..... B41M 5/00

[52] U.S. Cl. ..... 428/478.2; 428/195; 428/479.6; 428/500; 428/522; 428/535

[58] Field of Search ..... 428/195, 478.2, 428/479.3, 479.6, 500, 522, 535

[56] References Cited

U.S. PATENT DOCUMENTS

| | | | |
|---|---|---|---|
| 4,865,914 | 9/1989 | Malhotra | 428/331 |
| 5,118,570 | 6/1992 | Malhotra | 428/474 |
| 5,137,773 | 8/1992 | Malhorta | 428/215 |
| 5,372,884 | 12/1994 | Abe et al. | 428/331 |
| 5,474,843 | 12/1995 | Lambert et al. | 428/195 |
| 5,560,982 | 10/1996 | Sato | 428/195 |
| 5,605,750 | 2/1997 | Romano et al. | 428/304.4 |

FOREIGN PATENT DOCUMENTS

| | | |
|---|---|---|
| 0 707 977A | 10/1994 | European Pat. Off. . |
| 0 634 283A | 1/1995 | European Pat. Off. . |
| 0 650 850A | 5/1995 | European Pat. Off. . |
| 0 754 560A | 1/1997 | European Pat. Off. . |
| 3082589 | 4/1991 | Japan . |
| 56084992 | 9/1993 | Japan . |
| 7164730 | 6/1995 | Japan . |
| 7266686 | 6/1995 | Japan . |
| 7242055 | 9/1995 | Japan . |
| 7242056 | 9/1995 | Japan . |
| 7242057 | 9/1995 | Japan . |
| 7257015 | 10/1995 | Japan . |
| 7257016 | 10/1995 | Japan . |
| 8049193 | 2/1996 | Japan . |

*Primary Examiner*—Pamela R. Schwartz
*Attorney, Agent, or Firm*—Harold E. Cole

[57] ABSTRACT

An image recording element for inkjet ink images is disclosed. The element comprises a support, a base layer and a top layer. The base layer comprises gelatin and a material selected from the group consisting of carboxymethyl cellulose, polyvinylpyrrolidone, polyvinylalcohol, hydroxyethyl cellulose and mixtures thereof. The top layer comprises a material selected from the group consisting of an acrylic acid-diallyldimethylammonium chloride-hydroxypropyl acrylic copolymer and acrylic acid-diallyldimethylammonium chloride polymer.

9 Claims, No Drawings

HIGH UNIFORM GLOSS INK-JET RECEIVERS

FIELD OF THE INVENTION

This invention relates to inkjet ink imaging, particularly inkjet ink image recording elements.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol or a polyhydric alcohol or a mixed solvent of water and other water miscible solvents such as a monohydric alcohol or a polyhydric alcohol.

The recording elements typically comprise a support or a support material having on at least one surface thereof an ink-receiving or image-forming layer. The elements include those intended for reflection viewing, which usually have an opaque support, and those intended for viewing by transmitted light, which usually have a transparent support.

While a wide variety of different types of image-recording elements for use with inkjet ink devices have been proposed heretofore, there are many unsolved problems in the art and many deficiencies in the known products which have severely limited their commercial usefulness. The requirements for an image-recording medium or element for ink-jet recording are very demanding.

It is well known that in order to achieve and maintain photographic-quality images on such an image-recording element, the recording element must:

- Be readily wetted so there is no puddling, i.e. coalescence of adjacent ink dots, which leads to nonuniform density.
- Exhibit no image bleeding.
- Exhibit the ability to absorb high concentrations of ink and dry quickly to avoid elements blocking together when stacked against subsequent prints or other surfaces.
- Provide a high level of gloss and be sufficiently insoluble in typical ink solvents to avoid development of differential gloss.
- Exhibit no discontinuities or defects due to interactions between the support and/or layer(s), such as cracking, repellencies, comb lines and the like.
- Not allow unabsorbed dyes to aggregate at the free surface causing dye crystallization, which results in bloom or bronzing effects in the imaged areas.
- Be optimized for image fastness to avoid fade from contact with radiation by daylight, tungsten light, or fluorescent light.

SUMMARY OF THE INVENTION

The present invention provides an image recording element for inkjet ink images comprising, in the following order, a support, a base layer and a top layer, wherein:

- the base layer comprises comprises gelatin and a material selected from the group consisting of carboxymethyl cellulose, polyvinylpyrrolidone, polyvinylalcohol, hydroxyethyl cellulose and mixtures thereof; and
- the top layer comprises a material selected from the group consisting of an acrylic acid-diallyldimethylammonium chloride-hydroxypropyl acrylic copolymer and acrylic acid-diallyldimethylammonium chloride polymer.

This receiver provides a high gloss ink jet ink recorded images. The high uniform gloss is in inked (imaged) and non-inked (non image) areas. The gloss is independent of the ink sets used. Also the imaged receivers are free of white spots, that is free of spots that are void of ink.

DETAILED DESCRIPTION OF THE INVENTION

In the present invention, the recording element can be opaque, translucent, or transparent. Thus, the supports utilized in the recording element of the present invention are not particularly limited and various supports may be employed. Accordingly, plain papers, resin-coated papers, various plastics including a polyester-type resin such as poly(ethylene terephthalate), poly(ethylene naphthalate) and polyester diacetate, a polycarbonate-type resin, a fluorine-type resin such as ETFE, metal foil, various glass materials, and the like can be employed as supports. When the supports of the present invention are transparent, a transparent recording element can be obtained and used as a transparency in an overhead projector.

The supports employed in the present invention must be self-supporting. By "self-supporting" is meant a support material such as a sheet of film that is capable of independent existence in the absence of a supporting support.

The thickness of the support can be 12 to 500 $\mu$m, usually 75 to 300 $\mu$m.

If desired, in order to improve the adhesion of the base layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer can be applied to the surface of the support.

The base layer is primarily intended as a sponge layer for the absorption of ink solvent. As such, it is primarily composed of hydrophilic or porous materials. It has a thickness of 3 to 20 $\mu$m. In this invention the base layer comprises gelatin mixed with hydrophilic materials selected from the group consisting of carboxymethyl cellulose, polyvinylpyrrolidone (PVP), polyvinylalcohol, hydroxyethyl cellulose, hydroxpropyl methyl cellulose, and hydroxpropyl ethyl cellulose including mixtures of members of this group. The coated layers have ratio of solids of hydrophilic materials to gelatin of 90:10 to 60:40 by weight, with the preferred ratio being 80:20 by weight.

Carboxymethyl cellulose or CMC is available as Celfix-5 (available from Riverside Chem), Cellogen HP5A, Cellogen HP6A, and Cellogen HP8A (available form Multi-Kem Corp,). Useful polyvinypyrrolidone include PVP K-90, K-60, K-120 (ISP Technologies Inc.). Coating mixtures with these materials had a ratio of solids of PVP:gelatin of 90:10 to 60:40 by weight, with the preferred ratio being 80:20. The coating mixtures pH were adjusted with HCl to a pH of 3.0 to 4.5. A pH 3.5 is preferred.

Other materials useful in the base layer include cellulose derivatives, gum derivatives, chitosan, starch, or other materials which are obvious to those skilled in the art.

A porous structure may be introduced into the base layer by the addition of ceramic or hard polymeric particulates, by foaming or blowing during coating, or by inducing phase separation in the layer through introduction of nonsolvent. In general, it is sufficient for the base layer to be hydrophilic, but not porous. This is especially true for photographic quality prints, in which porosity may cause a loss in gloss. Optionally, rigidity may be imparted to the base layer through incorporation of a second phase such as polyesters, poly(methacrylates), polyvinyl benzene-containing copolymers and the like.

The base layer may be pH adjusted to optimize swelling (water capacity), to enhance gloss or to minimize dye migration. For example, in one embodiment of the invention, the pH of the layer is reduced to 3.5 to improve swelling capacity, thereby reducing ink drying times, and to impart waterfastness. In another embodiment, the pH of the image recording layer is raised to 8.5 in order to enhance gloss and reduce bronzing due to surface dye crystallization.

In the preferred embodiment of this invention, the base layer is comprised of 50%–100% photographic-grade gelatin, modified such that the pH is far from the isoelectric point of such a gelatin, in order that water uptake may be maximized. The remainder of the layer may consist of the above listed hydrophillic polymers.

As stated before the base layer bears an overcoat comprising polymers selected from the group consisting of acrylic acid-diallyldimethylammonium chloride-hydroxypropyl acrylic copolymer and acrylic acid-diallyldimethylammonium chloride polymer. In a useful embodiment the acrylic acid-diallyldimethylammonium chloride-hydroxypropyl acrylic copolymer contains 18 weight percent acrylic acid, 62 weight percent diallyldimethylammonium chloride and 20 weight percent hydroxypropyl acrylate; and the acrylic acid-diallyldimethylammonium chloride polymer contains 23 weight percent acrylic acid and 77 weight percent diallyldimethylammonium chloride. These overcoats have a dry thickness of 0.25 to 1.0 $\mu$m. The preferred thickness is 0.25 to 0.35 $\mu$m.

Since the image recording element may come in contact with other image recording articles or the drive or transport mechanisms of the image recording devices for which its use is intended, additives such as surfactants, lubricants, matte particles and the like may be optionally added the element to the extent that they do not degrade properties of interest.

The layers described above, including the base layer and the top layer, may be coated by conventional coating means onto a transparent or opaque support material commonly used in this art. Coating methods may include, but are not limited to wound wire rod coating, slot coating, slide hopper coating, gravure, curtain coating and the like. Some of these methods allow for simultaneous coatings of both layers, which is preferred from a manufacturing economic perspective.

The inks used to image the recording elements used in the present invention are well-known inks. The ink compositions used in ink-jet printing typically are liquid compositions comprising a solvent or carrier liquid, dyes or pigments, humectants, organic solvents, detergents, thickeners, preservatives, and the like. The solvent or carrier liquid can be comprised solely of water or can be predominately water mixed with other water-miscible solvents such as polyhydric alcohols, although inks in which organic materials such as polyhydric alcohols are the predominant carrier or solvent liquid also may be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758.

Although the recording elements disclosed herein have been referred to primarily as being useful for ink-jet printers, they also can be used as recording media for pen plotter assemblies. Pen plotters operate by writing directly on the surface of a recording medium using a pen consisting of a bundle of capillary tubes in contact with an ink reservoir.

The following examples further illustrate the invention and the benefits flowing therefrom.

EXAMPLE 1

An aqueous solution at 8 percent solids by weight was prepared, consisting of carboxymethyl cellulose (CELFIX 5) and gelatin at a ratio of 80/20 by weight. The solution was coated as a base layer on a resin coated paper that was corona discharged treated to a dry thickness of 8 $\mu$m.

An aqueous solution consisting of Floc Aid-19 was prepared at 2 percent by weight solids, to which 0.1 percent by weight of the surfactant Olin 10G was added. This was coated over the base layer at a dry thickness of 0.35 $\mu$m.

EXAMPLE 2

An element was prepared as in example 1 except Cellogen-HP5A was substituted for carboxymethyl cellulose in the base layer.

An aqueous solution consisting of Floc Aid-34 was prepared at 2 percent by weight solids, to which 0.1 percent by weight the surfactant Olin 10G was added. This was coated over the base layer at a dry coverage of 0.35 microns.

EXAMPLE 3

An aqueous solution at 8 percent solids by weight was prepared, consisting of PVP K-90 and gelatin at a ratio of 80/20 by weight. The solution pH was adjusted to 3.5 with hydrochloric acid. The solution was coated on a resin coated paper that was corona discharged treated to a dry thickness of 8 microns.

An aqueous solution consisting of Floc Aid-19 was prepared at 2 percent by weight solids, to which 0.1 percent by weight of the surfactant Olin 10G was added. This was coated over the base layer at a dry thickness of 0.35 $\mu$m.

EXAMPLE 4

An aqueous solution at 8 percent solids by weight was prepared, consisting of PVP K-90 and gelatin at a ratio of 80/20 by weight. The solution pH was adjusted to 3.5 with hydrochloric acid. The solution was coated on a resin coated paper that was corona discharged treated to a dry thickness of 8 microns.

An aqueous solution consisting of Floc Aid-34 was prepared at 2 percent by weight solids, to which 0.1 percent by weight of the surfactant Olin 10G was added. This was coated over the base layer at a dry thickness of 0.35 $\mu$m.

Gloss Measurements were measured with a Gardner Micro Tri Gloss Meter, Model 4520, at a setting of 60 degrees. The measurements were taken in each of the colors of cyan, magenta, yellow, blue, red, green, black, and white. The results are summarized in Table 1.

TABLE 1

| 60 Degree Gloss Measurements Encad Pro Printer | | | | | | | | |
|---|---|---|---|---|---|---|---|---|
| Example No. | C | M | Y | R | G | B | BK | W |
| 1 | 77 | 79 | 73 | 74 | 76 | 74 | 75 | 78 |
| 2 | 72 | 73 | 75 | 77 | 71 | 64 | 73 | 76 |
| 3 | 77 | 75 | 77 | 84 | 77 | 84 | 67 | 91 |
| 4 | 87 | 86 | 92 | 83 | 83 | 79 | 84 | 79 |

Table 1 shows that the elements of the invention exhibit excellent gloss.

White spots as previously defined are voids in the inked areas where no ink is present. The evaluation for white spots is a visual check looking for said voids or white spots. If any white spots were observed the sample failed. Only the samples with no white spots anywhere passed. Table 2 presents the results observed with elements of the invention.

TABLE 2

| White Spot Evaluation vs. Printers | | | |
|---|---|---|---|
| Printers | Encad Pro | Encad Nova Jet II | Laser Master |
| Example 1 | NO | NO | NO |
| Example 2 | NO | NO | NO |
| Example 3 | NO | NO | NO |
| Example 4 | NO | NO | NO |

This table shows that the same elements of Table 1 are free of white spots when printing is carried out on different printers using different ink sets.

The invention has been described in detail with particular reference to certain preferred embodiments thereof, but it will be understood that variations and modifications can be effected within the spirit and scope of the invention.

What is claimed is:

1. An image recording element for inkjet ink images comprising, in the following order, a support, a base layer and a top layer, wherein:

the base layer comprises gelatin and a material selected from the group consisting of carboxymethyl cellulose, polyvinylpyrrolidone, polyvinylalcohol, hydroxyethyl cellulose and mixtures thereof, said base layer having a thickness of 3 to 20 $\mu$m; and the top layer consists essentially of a material selected from the group consisting of an acrylic acid-diallyldimethylammonium chloride-hydroxypropyl acrylic copolymer and acrylic acid-diallyldimethylammonium chloride polymer, said top layer having a thickness of 0.25 to 1.0 $\mu$m.

2. The element of claim 1 wherein the top layer comprises polymers selected from the group consisting of (a)an acrylic acid-diallyldimethylammonium chloride-hydroxypropyl acrylic copolymer containing 18 weight percent acrylic acid, 62 weight percent diallyldimethylammonium chloride and 20 weight percent hydroxypropyl acrylate and (b) acrylic acid-diallyldimethylammonium chloride polymer containing 23 weight percent acrylic acid and 77 weight percent diallyldimethylammonium chloride.

3. The element of claim 1 comprising a resin coated paper support and a base layer of carboxymethyl cellulose and gelatin.

4. The element of claim 3 wherein the carboxymethyl cellulose:gelatin ratio in the layer is in the range of 90:10 to 60:40 by weight.

5. The element of claim 4 wherein the carboxymethyl cellulose:gelatin ratio is 80:20 by weight.

6. The element of claim 1 having a resin coated paper support and the base layer consists of a mixture of polyvinylpyrrolidone and gelatin.

7. The element of claim 6 wherein the polyvinylpyrrolidone:gelatin ratio in the layer is in the range of 90:10 to 60:40 by weight.

8. The element of claim 7 wherein the polyvinylpyrrolidone:gelatin ratio is 80:20.

9. A high gloss ink jet ink recorded image element free of white spots comprising, in the following order, a support, a base layer and a top layer, wherein:

the base layer comprises gelatin and a material selected from the group consisting of carboxymethyl cellulose, polyvinylpyrrolidone, polyvinylalcohol, hydroxyethyl cellulose and mixtures thereof, said base layer having a thickness of 3 to 20 $\mu$m; and the top layer consists essentially of a material selected from the group consisting of an acrylic acid-diallyldimethylammonium chloride-hydroxypropyl acrylic copolymer and acrylic acid-diallyldimethylammonium chloride polymer, said top layer having a thickesss of 0.25 to 1.0 $\mu$m.

* * * * *